US008398571B2

(12) United States Patent
Ellin

(10) Patent No.: US 8,398,571 B2
(45) Date of Patent: Mar. 19, 2013

(54) VIBRATION PAD COVER AND VIBRATION TREATMENT SYSTEM

(76) Inventor: Philip James Ellin, Rotherham (GB)

( * ) Notice: Subject to any disclaimer, the term of this patent is extended or adjusted under 35 U.S.C. 154(b) by 515 days.

(21) Appl. No.: 12/598,594

(22) PCT Filed: May 2, 2008

(86) PCT No.: PCT/GB2008/050324
§ 371 (c)(1),
(2), (4) Date: Jan. 26, 2010

(87) PCT Pub. No.: WO2008/135788

PCT Pub. Date: Nov. 13, 2008

(65) Prior Publication Data

US 2010/0191159 A1 Jul. 29, 2010

(30) Foreign Application Priority Data

May 3, 2007 (GB) ..... 0708575.6

(51) Int. Cl.
*A61H 1/00* (2006.01)

(52) U.S. Cl. ..... 601/58; 601/49; 601/56

(58) Field of Classification Search ..... 601/46, 601/49, 56–59, 66
See application file for complete search history.

(56) References Cited

U.S. PATENT DOCUMENTS

| | | | | |
|---|---|---|---|---|
| 2,917,043 | A | 12/1959 | Murphy | |
| 3,019,785 | A | 2/1962 | Eiden | |
| 2002/0049395 | A1 * | 4/2002 | Thompson et al. | 601/2 |
| 2004/0077978 | A1 * | 4/2004 | Nelson et al. | 601/70 |
| 2006/0247601 | A1 | 11/2006 | Ellin et al. | |
| 2007/0055179 | A1 * | 3/2007 | Deem et al. | 601/2 |
| 2007/0088245 | A1 * | 4/2007 | Babaev et al. | 604/22 |

FOREIGN PATENT DOCUMENTS

| | | |
|---|---|---|
| GB | 2096899 | 10/1982 |
| WO | WO02065973 A1 | 8/2002 |

* cited by examiner

*Primary Examiner* — Nicholas Lucchesi
*Assistant Examiner* — Leah Stohr
(74) *Attorney, Agent, or Firm* — Keeling Patents & Trademarks, LLC; Melissa M. Martinez; Kenneth A. Keeling

(57) ABSTRACT

A cover (150) for a vibratory pad (10) comprises a pocket or pouch (158) faced with dressing fabric material and sized to accommodate a vibration pad, a closure (154*e*) to retain the cover on the pad, in use, and a strap (146,148) integral with the cover suitable for connecting the cover (and a pad retained therein) to the limb (29) of a patient. The strap has an (adhesive) connector (176) that is capable of being secured so as to pressure the pad against the limb and so that, once made, the connection cannot be unmade without disabling the connector against making subsequent connections. Thus the cover can only be used once. A system (12'150') includes the vibration device and comprises means to disable the device after a cover has been employed for a period of time or number of treatments.

22 Claims, 5 Drawing Sheets

VIBRATION PAD COVER AND VIBRATION TREATMENT SYSTEM

CROSS-REFERENCE TO RELATED APPLICATIONS

This application claims the benefit of, and priority to, application number 0708575.6, which was filed in the United Kingdom on May 3, 2007, which application is incorporated herein by reference as if reproduced in full below.

STATEMENT REGARDING FEDERALLY SPONSORED RESEARCH OR DEVELOPMENT

Not applicable.

FIELD OF THE INVENTION

This invention relates to a cover for a vibration pad and to a vibration treatment system employing such a cover.

BACKGROUND

Our co-pending application number WO-A-02065973 discloses a method of treatment of lymphodema and leg ulcers and a prophylactic treatment for deep vein thrombosis (DVT) employing mechanical vibrations, particularly cycloidal vibration, employing a vibration pad. Cycloidal vibration is a small amplitude, 0.1 and 0.5 mm, low frequency, 15 to 75 HZ, vibration that produces motion in three different directions, each of these directions will be at different points in its cycle. It is the out of "phase" relationship which gives rise to the term cycloid vibration. GB-A-2096899 and U.S. Pat. No. 3,019,785 disclose a vibration pad device comprising a motor mounted in a frame, the frame extending into a pad and the motor driving an eccentric weight that causes cycloid vibration of the pad. Cycloidal vibration can be administered by means of integration of the mechanism into static products such as a portable pad as disclosed in GB-A-2096899, but equally it can be incorporated in a mattress, of a therapy couch, for example.

U.S. Pat. No. 2,006,247601 relates to the treatment of cellulitis. Cellulitis is a common skin infection. In 2002 to 2003, in the UK, there were nearly 60,000 recorded admissions into hospital. Each admission can take on average 10 days to treat (2), accounting for up to six hundred thousand-bed days per annum. Most commonly affecting the lower limbs, cellulitis is an acute infection of the skin and subcutaneous tissues, characterised by: local heat, redness, pain, erythematous tissue and swelling. It is commonly caused by the bacteria streptococci and is associated with, or can be a consequence of, lower limb swelling/oedema. This can be due to a mix of any of the following: leg oedema, venous hypertension, lymphodema, chronic ulceration and immobility.

U.S. Pat. No. 2,006,247601 provides a method of treatment of cellulitis comprising the steps of administering one or more antibiotics and applying a vibration pad to the region of the skin affected by cellulitis and submitting the pad to cycloid vibration for a period of at least 30 minutes at least once per day until the infection diminishes. The vibrations are believed to assist transport of the antibiotics to the site of infection so that they have their effect more rapidly and completely.

Leg ulcers, lymphodema and cellulitis all result, to a greater or lesser extent, in exudation from the skin of potentially infectious material. WO-A-02065973 proposes the use of a cover for the vibration pad, so that exudates can be isolated from the pad and any weeping or bleeding of wounds can be absorbed by the cover and not infect the surface of the pad. However, there is a strong tendency in all environments to reuse apparatus and in today's environmentally-conscious society the temptation not to waste disposable medical supplies can sometimes lead to risks being taken. In fact, the danger of cross-infection is far more costly, even just in environmental terms, than a strict adherence to a single-use policy regarding medical products, and this includes covers of vibration pads.

It is an object of the present invention to provide a cover including means to substantially guarantee single use thereof, or at least to make it difficult to reuse.

BRIEF SUMMARY OF THE DISCLOSURE

In accordance with the present invention there is provided a cover for a vibratory pad comprising a pocket faced with dressing fabric material and sized to accommodate a vibration pad, a closure to retain the cover on the pad, in use, and a strap integral with the cover suitable for connecting the cover and a pad retained therein to the limb of a patient, said strap having a connector that is capable of being secured so as to pressure the pad against the limb and so that, once made, the connection cannot be unmade without disabling the connector against making subsequent connections. Thus the cover can only be used once.

From an infection control perspective, and because the cover and straps are in direct contact with infected skin that is often leaking exudate/fluid, particularly during vibration treatments, it is undesirable that the recovering skin/limb should be in contact with the same cover and straps that may have been contaminated with bacteria-infected skin cells or fluid from earlier stages of the treatment. Replacement of the cover per treatment session may aid recovery and assist in preventing reoccurrence of infection.

Preferably said connector comprises a strip of adhesive and said material of the cover is of the type to which the adhesive adheres non-releasably. Here, non-releasably means that the adhesion between the strap and the material of the cover is such that the connection between the strap and cover cannot be unmade without losing the capacity of the adhesive to adhere the strap again to the material of the cover.

Thus the adhesive may be so strong that the adhesive bond cannot be broken at all, and that, in order to disconnect the pad from a patient's leg, the strap must be broken or cut.

Alternatively, the material of the cover may be layered, whereby when the strap is disconnected from the cover, a surface layer of the cover is detached from the cover remaining adhered to the strap, whereby the strap no longer has capacity to secure the pad to a patient's limb. In this sense, "layered" does not necessarily mean that discrete layers exist in the material of the cover but only that what elements of the cover that become adhered to the strap have greater cohesion to the adhesive of the strap than to the remainder of the cover and detach therefrom on peeling of the strap.

Alternatively, the adhesive of the strap may have greater cohesion to the material of the cover than to the remaining material of the strap. In this event, on peeling of the strap, the adhesive may be left attached to the cover, but like in the previous alternative, in accordance with the present invention, material of the strap must detach from the strap to remain connected to the adhesive so as to destroy the capacity of the adhesive to effect another connection to the strap.

Preferably, the adhesive is protected by a release layer prior to use.

Preferably, said cover comprises two sheets of material connected together along three edges to form a pocket, a fourth edge of one sheet of said two sheets having an extended flap provided with a closure whereby a pad inserted in the open mouth of the pocket formed between said fourth edges of the sheets may be retained therein. Preferably, said closure is of the type that, once closed cannot be opened without disabling the closure against making subsequent closure. Preferably said closure comprises a strip of adhesive and said material of the cover is of the type to which the adhesive adheres non-releasably.

Preferably, one of said sheets includes at least one extension from one of said three sides and forming said strap. Preferably, said extension is from a first side of the sheet adjoining said fourth side. Preferably, two of said extensions are formed from the same side providing two straps. Preferably, the third side is also provided with a strap or straps corresponding with that or those of the first side. Preferably, said closure flap extends from one of said sheets being a front sheet, and the strap or straps extend from the other of said sheets being a rear sheet, the front sheet being the sheet intended, in use, to be against a patient's leg.

Preferably, said material of the cover comprises a waterproof layer and at least one absorbent layer. Said waterproof layer may be a sheet of plastics material, preferably a thermoplastic material, such as polyethylene. Said absorbent layer may comprise a fibrous flock adhered to said waterproof layer. Said fibrous flock may be paper. Said connection between said sheets of material may be by welding said thermoplastic components of the sheets to each other. Preferably, said waterproof layer is sandwiched between two of said absorbent layers.

Said cover may comprise a single sheet and said closure may comprise a draw string whereby the sheet is formable into said pouch to accommodate the pad. The drawstring may be a closed loop of elasticated material, in which event the pouch is snapped over the vibration pad to fit it.

Indeed, said cover may comprise a single sheet and said closure may comprise said connector, which is in the form of a strap extending from a side of said sheet and adapted to wrap around said pad and said limb, and secure to said sheet, and whereby the sheet is formable into said pouch to accommodate the pad.

Alternatively, the connector could be in the form of at least two pairs of straps extending from either side of said sheet and adapted to wrap around said pad and said limb, and whereby the sheet is formable into said pouch to accommodate the pad. In this event, the straps cross over one another, and so a single pair would not provide an stability for the connection.

In a different aspect, the present invention provides a vibration treatment system comprising a vibration device and a cover therefor, wherein the vibration device comprises a motor driving a vibration element and a pad connected to the motor whereby vibrations caused by rotation of the motor are transmitted to and by the pad, a controller controlling operation of the motor and including a first interface element, and wherein the cover comprises sheet material to protect the pad against contamination when the system is in use, the cover including a second interface element and a disabler, and wherein said first and second interface elements are interengageable on application of the cover to the pad whereby said controller detects the presence of the cover and enables operation of the motor for a period of time until the controller and disabler disable further operation of the motor until a different cover is applied to the pad.

Said first and second interfaces comprise a radio frequency transmission system. In this event, said disabler may comprise electric circuitry associated with the cover.

In one embodiment, said circuitry includes a unique identification code device that is read by the controller on interengagement of said first and second interfaces and entered into a memory forming part of the controller whereby, if the code is already in the memory the controller disables the motor from operating. If the code is not already in the memory, it is stored in the memory and the motor is enabled to operate for a period of time.

Said period of time may be a period of time suitable for a single period of therapy using the vibration device. Once the period has elapsed, the cover incorporating the second interface device and disabler are no longer able to operate with the vibration device and a new cover is required instead.

Said second interface and disabler may comprise a known passive radio frequency identification (RFID) tag that has no internal power supply. The vibration device may incorporate the known arrangements (reader) to activate and interrogate the RFID, but only over a very short distance commensurate with the cover being disposed on the vibration device. In such RFIDs, an antenna collects radio frequencies and the minute electrical current induced in the antenna by the incoming radio frequency signal provides just enough power for eg a CMOS integrated circuit in the tag to power up and transmit a response. Most existing passive tags signal by backscattering the carrier wave received from the reader. This means that the antenna is designed both to collect power from the incoming signal and also to transmit the outbound backscatter signal. The response of a passive RFID tag is not necessarily just an ID number; the tag chip can contain non-volatile, possibly writable EEPROM for storing data.

For example, one arrangement provides that a cover incorporating a tag is disposed on the vibration device. When the patient is ready, a button or other start signal is activated on the vibration device. The vibration device then transmits a signal to the RFID tag in the cover. The tag responds with a code that enables the vibration device to commence operation. At the same time, a clock in the in RFID begins to count down and, after a period of time, the code response is stopped by the RFID tag and the motor in the vibration device stops.

The advantage of this arrangement is that the vibration device does not require a large memory to store codes associated with previously used covers. Indeed, a used cover could not be reused on a different vibration device. Furthermore, covers could be tailored for specific uses, having different treatment times, and possibly having different physical characteristics, depending on the use. For example, where the cover is to be used for ulcer treatment or cellulitis, where wound weeping is a significant risk, the treatment time may be set quite short, probably limited to a single treatment period, to minimise the risk of cross- or re-infection; and the surface of the cover may be absorbent to retain any seepage. On the other hand, for deep vein thrombosis prophylactic treatment, the treatment time may be longer, or permit multiple treatments, and the cover not so absorbent. Moreover, the code transmitted by the cover may not only enable the vibration device but may inform the vibration device of the treatment regime to be employed, and the vibration device may operate at different levels of vibration, or in different modes, depending on the treatment being effected.

Passive RFID tags have practical read distances ranging from about 10 cm (4 in.) (ISO 14443) up to a few meters (Electronic Product Code (EPC) and ISO 18000-6), depending on the chosen radio frequency and antenna design/size. In the present invention, only a short range is required. Due to their simplicity in design they are also suitable for manufacture with a printing process for the antennas. The lack of an onboard power supply means that the device can be quite small: commercially available products exist that can be embedded in a sticker, or under the skin in the case of low frequency RFID tags.

Passive RFID tags are currently available with privacy enhancing technologies built-in, including built-in firewall access controls, and communication encryption. The ongoing problem with all RFIDs is that they need an external antenna which is 80 times bigger than the chip in the best version thus far developed. Nevertheless, this is not an issue with a cover for a vibration device that has plenty of surface area available. Further, the present costs of manufacturing tags has inhibited broader adoption. As silicon prices are reduced and new more economic methods for manufacturing inlays and tags are perfected in the industry this option is more likely to be relevant.

A further alternative arrangement of first and second interface is the use of induction coils. Indeed, this technology is currently employed with contactless smart cards. An integrated circuit chip communicates with the card reader through induction technology (at data rates of 106 to 848 kbit/s). These cards require only close proximity to an antenna to complete transaction. The standard for contactless smart card communications is ISO/IEC 14443, dated 2001. It defines two types of contactless cards ("A" and "B"), allows for communications at distances up to 10 cm.

Preferably, said first and second interfaces comprise a simple plug and socket, wherein the disabler comprises electric circuitry associated with the cover. The arrangements described above with reference to RFID tags are equally applicable here, the only different being that, instead of a transmitter and antenna, the interfaces are a plug and socket, but the functionality of the disabler can be exactly the same as with an RFID as described above. This arrangement is simpler in many respects and easier for a user to understand, and may be preferred.

Alternatively, however, the disabler in a simple plug and socket arrangement may comprise a fuse resistor, the circuit in the vibration device detecting the resistance of the fuse resistor when connection between the interfaces is made and, provided that the detected resistance is within a predetermined range of resistances, the motor is enabled to operate. However, a timer in the vibration device is arranged to send a current pulse to the fuse resistor to "blow" the fuse so that it goes into open circuit. Thereafter, no resistance is detected and the cover can no longer be employed. Again, the level of resistance may be employed to distinguish between covers for different applications and to tailor the time of permitted operation of the motor with that cover before the vibration device sends the signal blowing the fuse.

Any suitable disablement arrangement is contemplated. Indeed, in its broadest aspect, what the present invention provides is a vibration treatment system comprising a vibration device and a cover therefor, wherein the vibration device comprises a motor driving a vibration element and a pad connected to the motor whereby vibrations caused by rotation of the motor are transmitted to and by the pad, and the cover comprises sheet material to protect the pad against contamination when the system is in use and the cover is applied to the pad, wherein the system further comprises disablement means to disable use of the vibration device with a particular cover once that cover has been employed in a treatment regime.

In its simplest form, said disablement means comprises a strap integral with the cover suitable for connecting the cover when applied to a pad to the limb of a patient, said strap having a connector that is capable of being secured so as to pressure the pad against the limb and so that, once made, the connection cannot be unmade without disabling the connector against making subsequent connections. Thus the cover can only be used once.

However, in more sophisticated forms, said disablement means comprises a controller controlling operation of the motor and including a first interface element, and wherein the cover includes a second interface element and a disabler, and wherein said first and second interface elements are interengageable on application of the cover to the pad whereby said controller detects the presence of the cover and enables operation of the motor for a period of time until the controller and disabler disable further operation of the motor until a different cover is applied to the pad.

By virtue of the present invention, the hygiene arrangements around the use of vibration therapy for treatment of a range of conditions, a number of which carry a risk of infection and contamination, can be more assuredly provided.

BRIEF DESCRIPTION OF THE DRAWINGS

Embodiments of the invention are further described hereinafter with reference to the accompanying drawings, in which.

DETAILED DESCRIPTION

Figure 1:
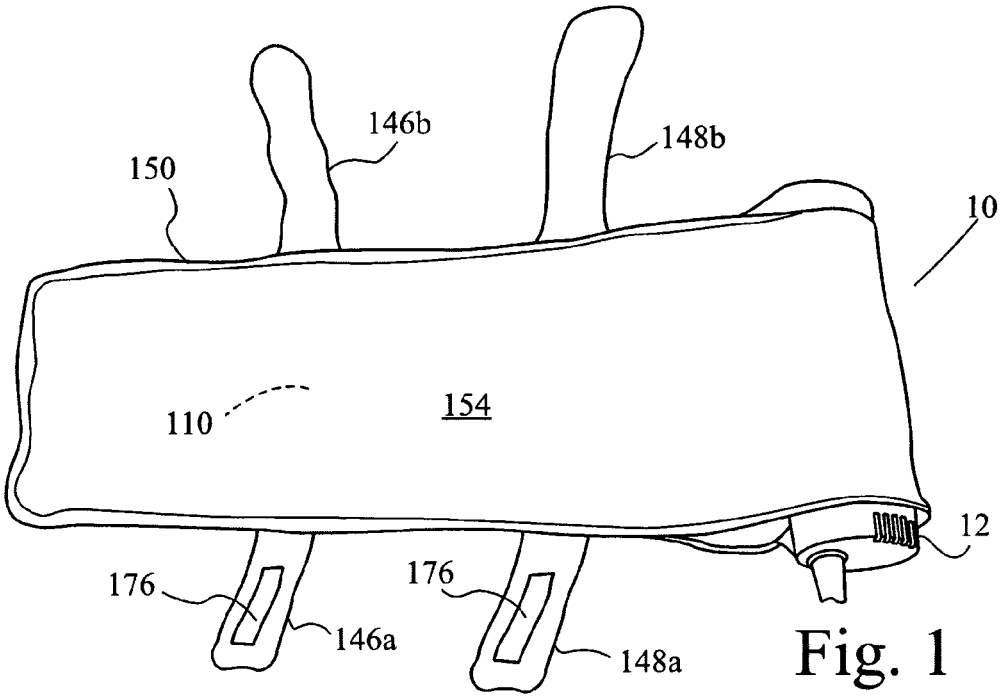
FIG. 1 is a perspective view of a vibratory massage device of the type employed in the present invention, (having attached thereto a transducer pack analysing the vibrations of the pad in three orthogonal directions x, y and z)

In the drawings, a vibratory massage device 10 of the type employed with the present invention comprises a drive unit 12. The drive unit comprises a casing 14 housing an electric low voltage DC motor 16 mounted in the casing through flexible mountings 18,20. The motor drives an eccentric weight 22 mounted on a fan 23 on each end of an armature 24. On rotation of the armature 24 motor 16 imparts a vibration in the casing 14 in a radial plane (x, y) with respect to the armature 24. Because the mountings 18,20 are soft, a component of the vibration occurs in a direction orthogonal (z) to the radial plane. Consequently, the vibration of the casing in response to the vibration of the motor is three-dimensional.

To the casing is fixed, by screws (not shown) retained in apertures 25 of the casing, a frame 27. On the frame is disposed fabric cushioning to form a pad 110. The motor is adapted to rotate at about 2400 rpm providing a frequency of vibration of about 40 Hz.

Depending on various factors (primarily connected with the degree of restraint placed upon the device by its location on the limb of an animal) the amplitude of vibration in each direction may be different and between about 0.1 mm and 0.5 mm. However, a speed control arrangement (not shown) is provided to control the power supplied to the motor.

Because the frame 27 is rigidly fixed to the casing 14 of the drive unit 12, vibrations of the drive unit 12 are therefore transmitted to the pad 110. The pad is about 400 mm long and about 250 mm wide at the motor end and about 200 mm wide at its other end.

Figure 2:
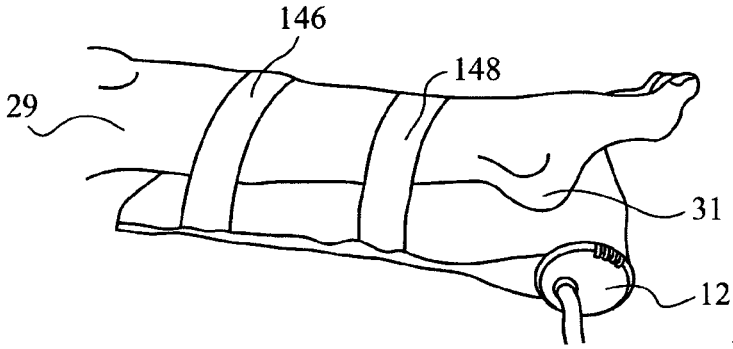
FIG. 2 is a side view of the device of FIG. 1 strapped to a patient's leg with the drive unit at the heel of the patient.
Figure 3:
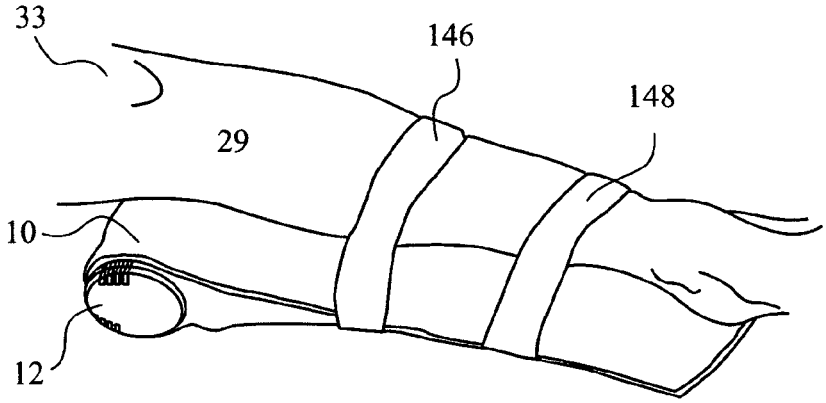
FIG. 3 is a similar view to FIG. 2, but with the drive unit under the knee of the patient.
Figure 4:
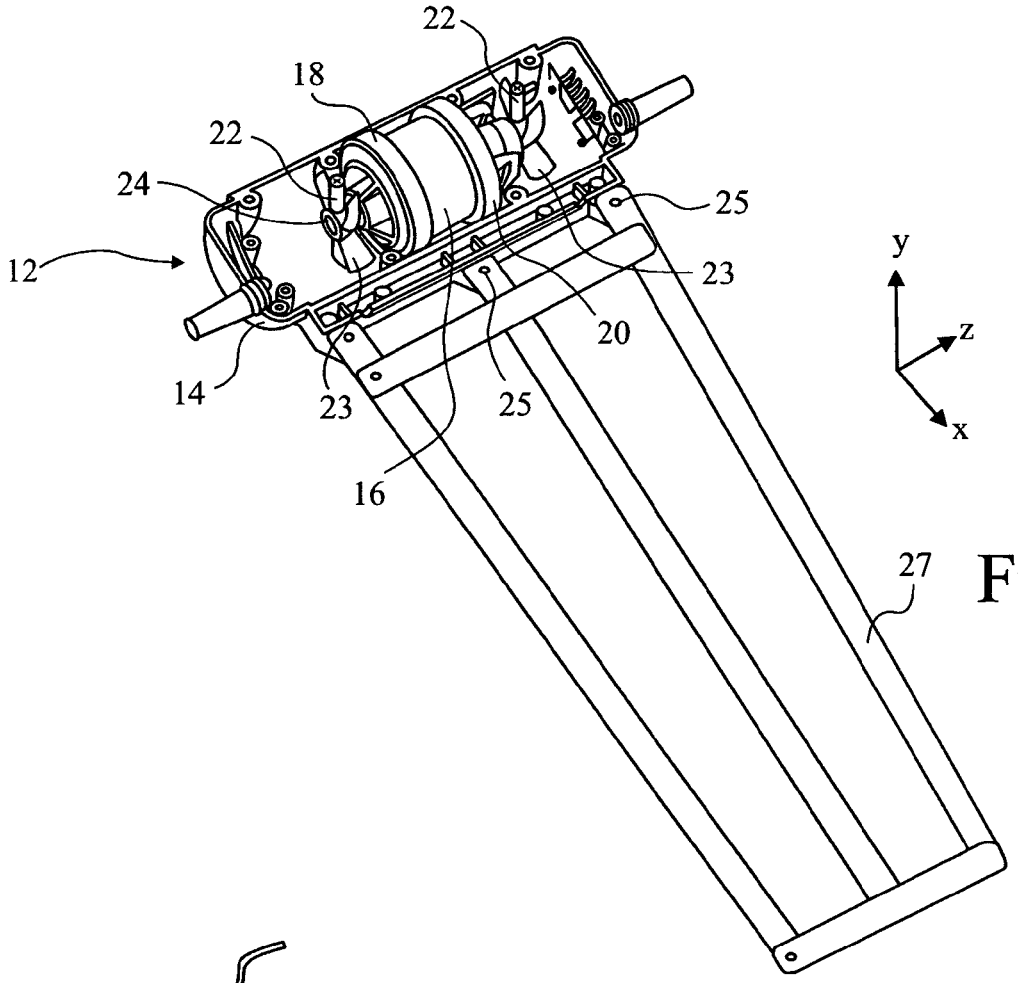
FIG. 4 is an assembly drawing of a drive unit and frame of the device of FIG. 1, a cover of the drive unit, and the padding of the frame being removed.
Figure 5:
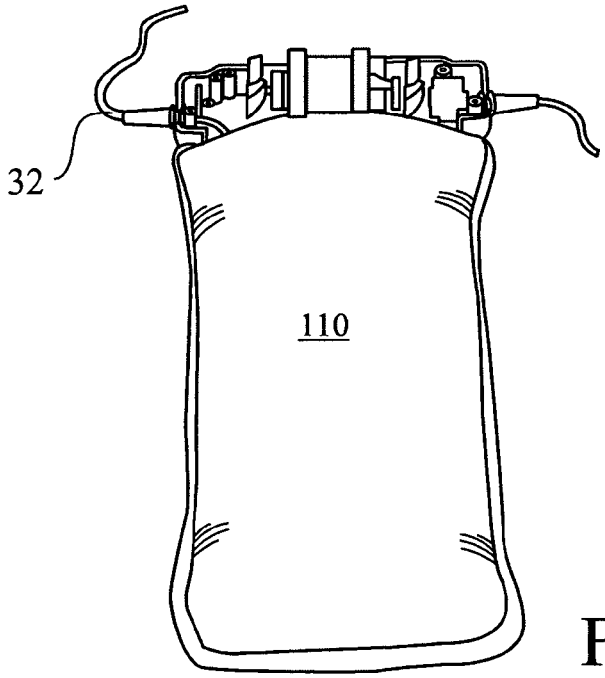
FIG. 5 is a perspective view of the device of FIG. 1, with the casing of the drive unit open.

In use, a patient, suffering from a leg ulcer or cellulitis or some similar and potentially infectious condition, lays the affected leg 29 longitudinally along the pad. Whether the motor is at the heel end 31 of the leg, as shown in FIG. 2, or is under the knee 33, as shown in FIG. 3, is a matter of patient choice. However, if an ulcer is on the patient's ankle or lower leg, the former arrangement may be preferable, whereas if it is on the calf or higher, the latter arrangement may provide more direct delivery of vibrations to the site and environment of the ulcer.

Figure 6:
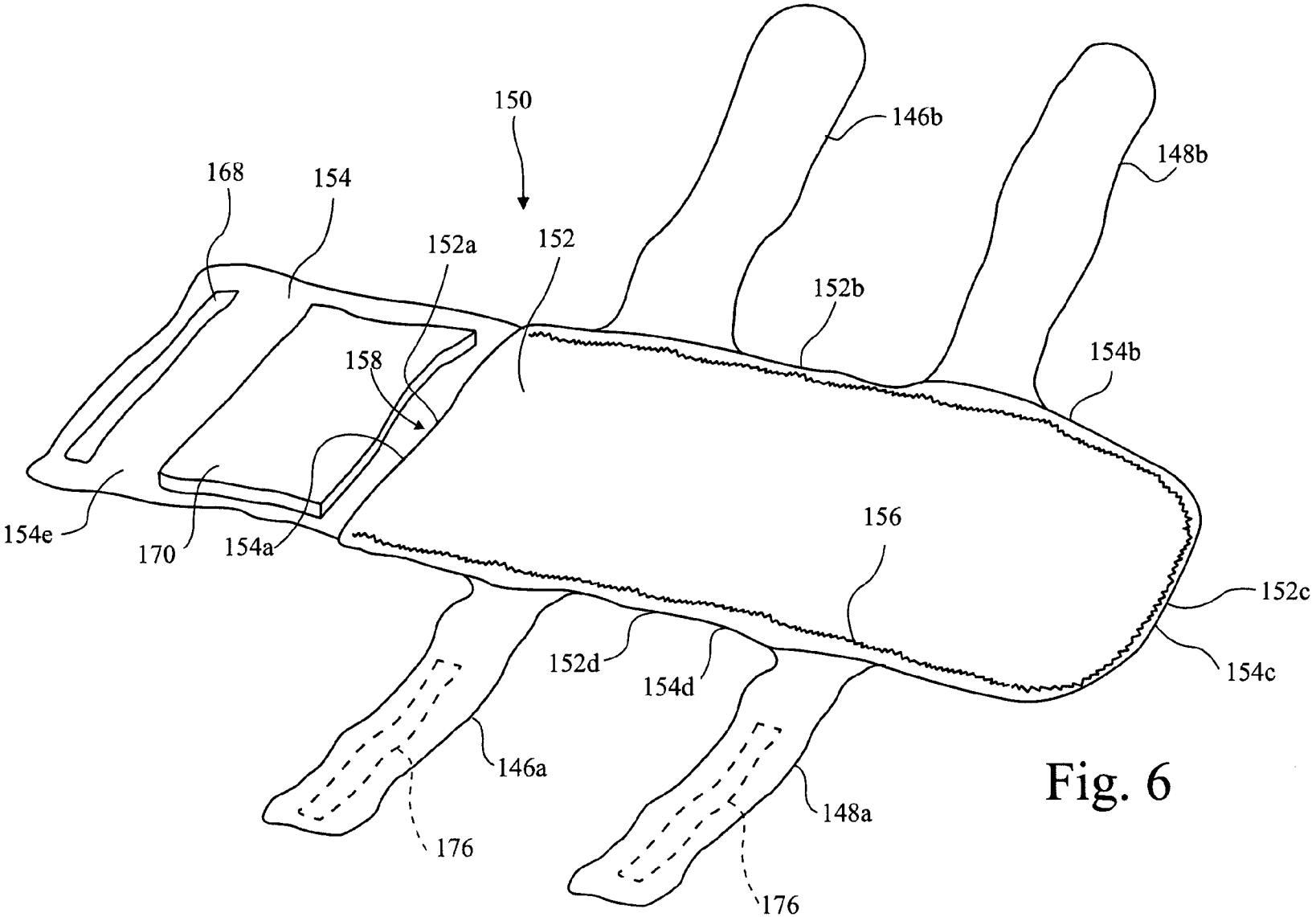
FIG. 6 is a perspective view of a cover in accordance with the present invention.

Turning to FIG. 6 a cover 150 is illustrated comprising a pocket or pouch formed from two sheets 152,154 each of an impervious, but soft-feel fabric, material. Such a material is a paper flock covered polyethylene or polypropylene sheet as frequently currently used surgical environments. For example, such material is presently sold by Kimberly-Clark® as surgical drapes and gowns manufactured from polypropylene fabric with the benefits of low linting, ignition resistance and exceptional barrier properties for protection from airborne and blood borne bacteria. However, the precise form of the sheet is within the ambit of the person skilled in the art and does not form part of the present invention. Nevertheless, in the context of the present invention, "impervious" should be understood to mean that liquid weeping from a bandaged ulcer of a patient undergoing treatment with the device will not, on the whole, penetrate the material and contaminate the pad. However, a certain breathability of the material is certainly permitted. Thus, for the purposes of patient comfort, the cover may not be utterly impervious and therefore on occasions some contamination may happen if significant leakage occurs.

Sheet 154 forms a front of the cover 150, adapted to lie against the skin of the patients leg, whereas sheet 152 forms the back. Each sheet has, essentially, four sides 152*a-d* and 154*a-d* together forming the same shape and being connected together along joint line 156 to form an open pouch 158. First ends 152*a*,154*a* are not connected together and form the open mouth of the pouch 158. Second, third and fourth edges 152*b-c* are connected to corresponding edges 154*b-c*, preferably by heat welding. End 154*a* of front sheet 154 is provided with an extension 154*e*. The pouch 158 of the cover 150 is shaped to snugly receive the pad 110 of a massage device 10 of the type shown in FIGS. 1 to 5. The motor 12 is not received in the pouch 158, however. Instead, the extension flap 154*e* covers the motor when the flap is folded over. An adhesive strip 168 is provided on the flap 154*e* to close the pouch 158 and retain the pad 10 within the confines of the cover 150. The adhesive strip 168 is adapted to adhere against the face of sheet 152. A foam pad 170 wraps the motor 12 and isolates to a significant degree direct vibrations of the motor from the patient.

The cover 150 has two pairs of straps 146*a,b* and 148*a,b* integral with the front side 154. The straps 146*a*,148*a* have adhesive strips 176 along their length. The strips are provided with protective release paper (not shown) to prevent inadvertent adhesion before they are ready. When a patient's leg is placed along the pad 110 (front face 154 of cover 150) the leg can be pressed against the device 10 by folding over the straps 146*a*,148*a* and engaging them with the other straps 146*b*, 148*b* to form closed securing loops 146,148 (see FIGS. 2 and 3).

The straps 146*b*,148*b* could be omitted if desired, but then the straps 146*a*,148*a* would have to be longer. The pressure applying means that is in the form of the straps 146,148 is employed to press the leg into close contact with the pad 110 so that vibrations penetrate deeply and widely into the flesh of the patient's limb.

In its first aspect of the present invention, the adhesive strips 176, and also desirably the strip 168, are selected, in combination with the material of the sheets 152,154, so that, once the straps are secured in position, their subsequent detachment destroys their capacity to form a further bond. This is inconvenient in some respects, because it does not allow for any adjustment of the pressure applied by the straps once they have been connected. However, this disadvantage is outweighed by the need to be sure that a fresh cover is employed for each patient, and that the risk of cross-infection between patients is minimised. It is not doubted that medical staff are trained to observe and be aware of the need for good clinical hygiene, but the present invention is provided so that best practice is not only reliant on the good sense of the staff.

The arrangement may be one of three:

First—the adhesive bond and cohesive strength of the materials connected by the adhesive are so strong that the straps cannot be detached at all without breaking them, rendering the cover incapable again of connecting the pad to a patient's leg;

Second and third—the cohesive strength of the materials connected by the adhesive is less than the adhesive bond between those materials (or one of them) and the adhesive, so that, despite the strap being peelable, the adhesive remains connected to one or other of the surfaces, the other surface breaking down and detaching from the sheet or strap, as the case may be, rendering the adhesive strip without any tackiness for effecting a further adhesion.

A suitable combination of sheet material and adhesive is as follows:

Sheet Material:

The disposable cover consists of sleeve constructed from Microgard® 2000, a material produced by Microgard Limited of Hull, United Kingdom. The seams of the cover are reinforced and ultrasonically welded. Microgard® 2000 technical profile

| | | | |
|---|---|---|---|
| Abrasion | EN 530 (method 2) | >500 | Class 3 |
| Bursting | ISO 2960 | 167 KpA | Class 2 |
| Tear | ISO 9073 | 39N (MD) | Class 1 |
| | | 25.7N (CD) | Class 1 |
| Fire retardency | EN1146:1997 | | Pass |
| Seam strength | EN13935-2:1999 | 106.1N | Class 3 |
| Chemical Repellency | EN 368 | Repellency index | Penetration |
| | n-Heptane | 87.7% | 0.1% |

-continued

| | | | |
|---|---|---|---|
| | Isopropanol | 93.9% | 0.0% |
| | Sulphuric Acid 30% | 98.1% | 0.0% |
| | NaOH 10% | 98.5% | 0.0% |
| Type 5 | Reduced Spray Test - prEN13034:1997 | | Pass |
| Type 6 (1&2) | Particle Penetration Suit test prENISO 13982 | | Pass |
| Surface Resistivity | EN 1149.1 | Conforms to all anti-static requirements | |
| Aloxite Penetration Test | | Particle Penetration through fabric only | |
| Royco Channel | 1.0-1.0 μm | <1% | |
| | 1.5-2.0 μm | <1% | |
| | 2.0-2.5 μm | <1% | |
| | 2.5-3.0 μm | <1% | |
| | 3.0-3.5 μm | <1% | |
| | >3.5 μm | no penetration | |

Fabric complies to CEN TC 162/WG3/TG3/N85 which requires particles in the size range 3.0-3.5 μm does not exceed 10% penetration.

Adhesive:

A Double Bonded Tape to either one of the following specifications:

3M 9571, a high tack acrylic adhesive, hand-tearable double tape, with a tissue carrier on an easy release paper liner; or 3M 9087 a double coated tapes with 3M Adhesive 375, providing a high level of adhesive peel and shear performance. The adhesive system used provides good adhesion to both high and low surface energy substrates. The excellent initial tack ensures that a bond of good integrity is achieved soon after application.

These products are supplied by 3M United Kingdom plc, Bracknell, UK.

Such a combination results in the second/third arrangement described above.

Figure 7A:
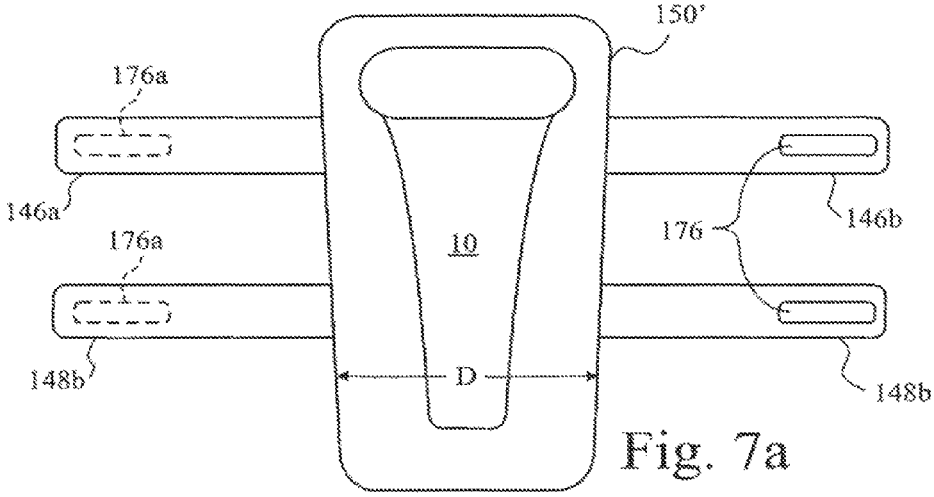
FIGS. 7*a* and *b* are plan views of two further embodiments of the present invention, ready to wrap a vibration pad, the embodiment of FIG. 7*a* having two overlapping strap pairs, while FIG. 7*b* has a single strap.
Figure 8:
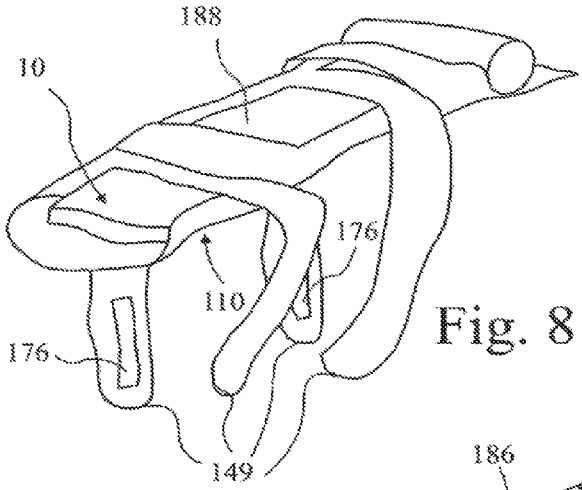
FIG. 8 is a perspective inverted view of the arrangement of FIG. 7, the pad and cover being shown ready to receive the limb of a patient.
Figure 9:
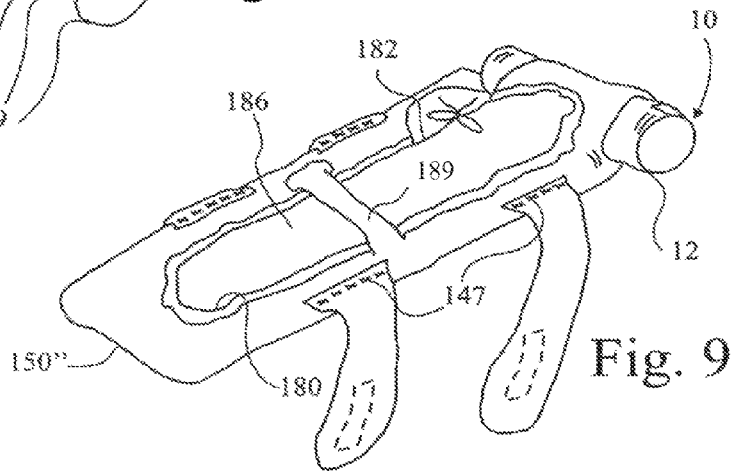
FIG. 9 being a perspective inverted view of a further embodiment of a cover in accordance with the present invention, on a vibration pad.

FIGS. 7 to 9 show further embodiments within the ambit of the present invention where the pouch or pocket is only formed when the pad is attached to the pad 10.

Thus, In FIG. 7*a*, the cover 150' comprises a single sheet of, for example, Microgard® 2000, having at least two pairs of long straps 146*a,b* and 148*a,b*, one each of which (b) is provided with the adhesive strip 176. In this embodiment (although it could equally apply to the other embodiments described herein as, indeed, those embodiments could apply here) further adhesive strips 176*a* are provided on the opposing straps (a). When joined, these form such a strong bond that they cannot be separated. To apply the cover 150', it is lain on a surface with its patient-facing surface (if it has one) face-down. The pad 10 is then placed face-down centrally on the cover, with its padded front face 110 (the face to be applied to the patient) against the cover 150'. The straps 146,148*a,b* are then folded over behind the pad 10 (as shown in FIG. 8), and passed across each other to extend back towards front surface 110. The pad and loosely attached cover is then turned over and a patient's limb is laid on the covered front face 110. The strap ends 149 are then passed over the limb and, after adjusting for tightness and comfort, the adhesive strips 176,176*a* are applied against each other securing not only the patient's limb to the pad, but the cover 150' to the pad, with the cover located between Thus here, the straps 146,148 have the function both of a closure for the pouch formed by the cover, once it is wrapped around the pad 10, as well as connectors for the pad/cover combination for connecting the patient's limb thereto. At least two connections are needed, in this event. While one, wider strap might appear feasible, since the straps must cross one another behind the pad 10, this cannot be achieved with only one strap and provide any stability. For stability, at least two strap (pairs) are required.

Figure 7B:
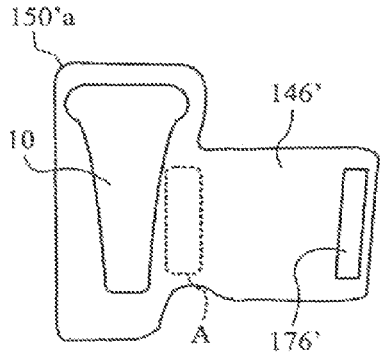

On the other hand, in FIG. 7*b*, an alternative cover 150'*a* of this type is shown with a single, wide strap 146' having a transverse adhesive strip 176' on which is positioned a pad 10, in the same position shown in FIG. 7*a*. When wrapped around the pad 10, and then around a patient's limb (not shown) on the far side of the cover 150'*a*, remote from the pad 10, the strip 176' can be adhered, after adjustment for appropriate tightness, to the cover 150'*a* on its front surface in the region A shown in dotted lines, which generally will be against the rear face of the pad 10, depending on the size of the patient's limb.

A gap 188 remains open at the back of the pad 10, and this may be deemed acceptable. However, it can be minimised simply by widening dimension D (see FIG. 7).

Turning to FIG. 9, a cover 150" is provided around its periphery with a hem 180 in which a draw-string 182 is threaded. Cover 150" may be provided with holes 184 to allow the motor casing 12 of the vibration pad 10 to protrude through once the cover is fitted. When the draw-string 182 is tightened and tied, the pouch so-formed surrounds the pad 10. However, a gap or hole 186 results at the rear of the vibration pad, and this may, on the one hand, be quite acceptable, since it is really only the front face that is exposed to the possibility of leaks and discharge from an infected limb. On the other hand, such access of biological material may be deemed undesirable, even at the rear face, and consequently, the hole 186 might be minimised, as described above. Alternatively, a preformed pouch, as described above with reference to FIG. 6 may be preferred. The drawstring 182, may be elasticated, in which event it may be provided closed and the cover 150" is snap-fitted over the pad 10.

In any event, the cover has straps 146*a,b*,148*a,b* as previous embodiments. Here the straps are shown as welded or otherwise connected at 147 to the cover 150". Equally, however, they could be integral, as the straps of the embodiments described above, as indeed, the straps may be welded or otherwise separately connected in the embodiments described above. In FIG. 9, the straps are shown arranged so that, when connected together, they would serve to spread the hole 186 and fail to connect the limb securely to the pad. This could be overcome by cross-pieces 189, or by arranging the straps as in the FIGS. 7*a,b* and 8 embodiments.

Figure 10:
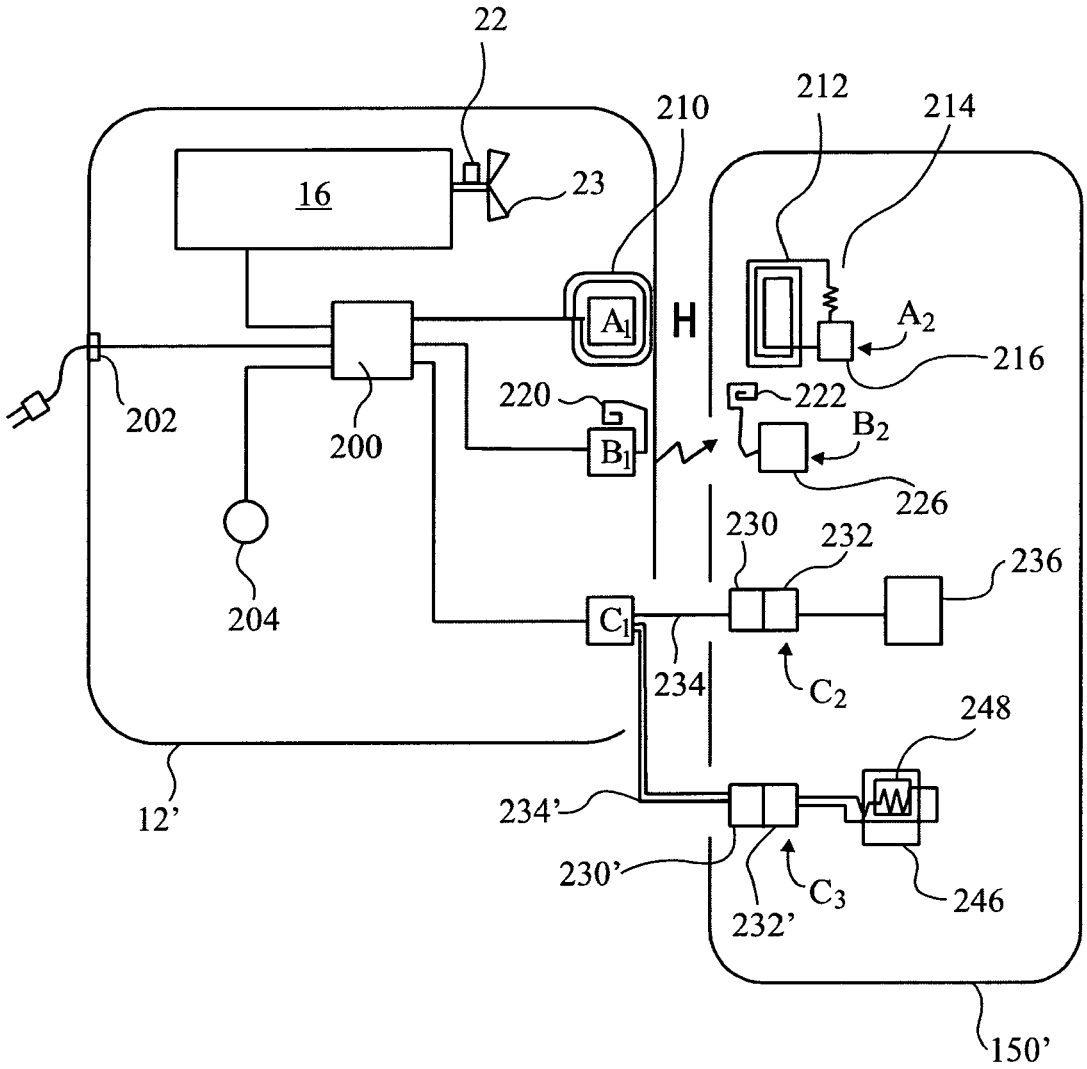
FIG. 10 is a schematic illustration of a number of possible alternative arrangements of disablement arrangements of the second aspect of the present invention.

Turning to FIG. 10, an alternative arrangement is disclosed in accordance with a second aspect of the present invention. While used properly and appropriately, the arrangement described above is perfectly satisfactory but it does suffer from two potential drawbacks. The first is already mentioned above in that the straps do not allow for any adjustment after a period of time if the straps should be too tight, or too loose. Secondly, the security they provide could simply be overcome, merely by employing some other means to apply pressure between the patient's limb and the vibration pad.

Accordingly, in FIG. 10, the vibration device 12' comprises a motor 16 (having its eccentric weight 22 and fan 23 as described above) controlled by a controller 200. The controller is provided with electrical power from a source 202 and supplies that power to the motor 16 when called for by activation of a start signal from device 204. Device 204 may be a button, but may be a device controlled remotely by means not shown.

When device 204 is activated the controller signals one or more of three options or first interfaces $A_1$, $B_1$, $C_1$. In a practical arrangement only one of these options is likely to be employed, although there is equally no reason why they all might not be available in a single device 12'.

A cover 150' is as described above, except here, any integrated straps (not shown) are adjustable by comprising hook and pile fasteners, or peelable and reusable adhesive connections. Consequently, tightness can be adjusted. However, the cover comprises a second interface that corresponds with one of the first interfaces $A_1$, $B_1$, $C_1$. In FIG. 10, four are shown, but only one would be employed in a particular cover Thus, interface $A_1$,$A_2$, comprises a magnetic induction link comprising induction loops 210,212 and a disabler circuit 214. The induction loop 212 and circuit 214 are disposed on the cover 150' and the disabler 214 may comprise a smart card type electronic chip 216 that is powered by the induction loop 216 and which modulates the response of the loop 212 so that the information contained in the chip 216 is transmitted to the first induction loop 210 and thence to the controller 200

Interface $B_1$,$B_2$ comprises a radio frequency transmission link between antennas 220 and 222, with antenna 222 being incorporated into the cover and being connected to electronic chip 226.

Interface $C_1$,$C_2$ comprises a hard wired plug 230 and socket 232 arrangement with an intervening cable connection 234. The socket 232 is provided in the cover 150' and connects to an integrated circuit 236. The plug 230 is one the end of the cable 234 forming part of the vibration device 12'. Of course, which is the plug and which is the socket is not material, nor whether the cable 234 is part of the cover or part of the device 150'.

Finally interface $C_1$,$C_3$ also comprises a cable 234', plug 230' and socket 232' arrangement (as interface $C_1$,$C_2$), but here the arrangement further comprises only a simple circuit 246. The arrangements of second interfaces and disablers $A_2$, $B_2$ and $C_2$ are described further below, but interface $C_1$,$C_3$ comprises a simple fuse resistor 248. When controller 200 is activated by device 204, it applies a small voltage across the fuse resistor 248 and detects the current though the circuit 246. If the current is within predefined limits, the controller actuates the motor 16. At the same time, the starts a clock (not shown, but which may be part of the controller 200) that counts down a predetermined time. That time may be dependent on the value of the current detected or may be fixed.

At the end of the allotted time, the controller sends a current spike through the circuit 246 that is sufficient to "blow" the fuse 248 and at the same time stops actuation of the motor and enters a restart mode. If the button 204 is activated again, the above procedure repeats except that, on this occasion, no current is detected and consequently the motor 16 does not start. Only if a new cover is applied with an intact fuse 248 will the motor run again. While the fuse is described herein as a resistor, the above principles apply to any component whose response parameters can be altered by a signal from the controller, and so that the controller can detect that those parameters have altered and that accordingly, the cover has been employed for a previous treatment regime.

Returning to interfaces $A_1$,$A_2$, $B_1$,$B_2$ and $C_1$,$C_2$, each, in fact, can employ the same electronic circuit arrangement 216,236,246. In this event, each is an integrated circuit chip of the type employed in smart cards, for example. Not only can such chips provide a unique identification code but also they can store information and therefore be adaptable. For example, they could provide a simple code that enables the controller 200 to actuate the motor, with a counter on the chip noting how long the cover is in use. After a period of time, which may or may not be a single period of time, the code transmitted may change or cease, disabling the controller and stopping it actuating the motor. Alternatively, the clock may be in the controller which, at the end of a treatment period sends a new signal to the chip on the cover which permanently changes the response the chip gives to the first signal. Thus should the pad be disconnected and reconnected to the cover, the pad receives a new code response from the cover which does not enable the controller and it does not activate the motor the start.

Another alternative is that the chip may simply transmit a more complex code when the cover is connected to the pad and the controller is ready to receive the code, and the controller stores the code a memory. Again, after a period of time (counted by either the controller or the chip) the motor might stop and the controller stores the code and does not actuate while a cover having that code is connected to it.

Thus the present invention provides, in several different ways, a system which prevents a cover being used more than once, (or more than a predetermined number of times or for more than a predetermined (cumulative) period of time) whereby the treatment system becomes more practical in that the risks from cross contamination can be reduced.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A vibration treatment system comprising a vibration device and a cover therefor, wherein the vibration device comprises a motor driving a vibration element and a pad connected to the motor whereby vibrations caused by rotation of the motor are transmitted to and by the pad, and the cover comprises sheet material to protect the pad against contamination when the system is in use and when the cover is applied to the pad, wherein the system further comprises disablement means to disable use of the vibration device with a particular cover once that cover has been employed in a treatment regime, wherein said disablement means comprises a controller controlling operation of the motor and including a first interface element, and wherein the cover includes a second interface element and a disabler, wherein said first and second interface elements are interengageable on application of the cover to the pad whereby said controller detects the presence of the cover and enables operation of the motor for a period of time until the controller and disabler disable further operation of the motor until a different cover is applied to the pad, wherein said first and second interfaces comprise a simple plug and socket, and said disabler comprises electric circuitry associated with the cover, said electric circuitry comprising a fuse resistor, the controller detecting the resistance of the fuse resistor when connection between the interfaces is made and, provided that the detected resistance is within a predetermined range of resistances, the motor is enabled to operate for said predetermined period of time.

2. A vibration treatment system as claimed in claim 1, in which said period of time is a period of time suitable for a single period of therapy using the vibration device.

3. A vibration treatment system as claimed in claim 1, in which said covers are tailored for specific uses, having variable treatment time periods, and optionally having different physical characteristics, depending on the use.

4. A vibration treatment system as claimed in claim 3, in which said cover is to be used for ulcer treatment or cellulitis, where wound weeping is a significant risk, the treatment time being set for between 15 and 30 minutes and being limited to a single treatment period.

5. A vibration treatment system as claimed in claim 3, in which said cover is to be used for deep vein thrombosis prophylactic treatment, the treatment time being set for up to one hour and permitting multiple treatments.

6. A vibration treatment system as claimed in claim 3, in which the level of resistance of the fuse resistor is employed to distinguish between covers for different applications and to tailor the time of permitted operation of the motor with that cover before the vibration device sends the signal blowing the fuse.

7. A vibration treatment system as claimed in claim 1, in which, the controller sends a current pulse to the fuse resistor to "blow" the fuse so that it goes into open circuit, thereafter no resistance being detected by the controller and consequently disabling the device at the end of said period of time.

8. A vibration treatment system as claimed in claim 1, in which said cover comprises two sheets of material connected together along three edges to form a pocket, a fourth edge of one sheet of said two sheets having an extended flap provided with a closure whereby a pad inserted in the open mouth of the pocket formed between said fourth edges of the sheets may be retained therein.

9. A vibration treatment system as claimed in claim 8, in which said closure is of the type that, once closed, cannot be opened without disabling the closure against making subsequent closure.

10. A vibration treatment system as claimed in claim 9, in which said closure comprises a strip of adhesive and said material of the cover is of the type to which the adhesive adheres non-releasably.

11. A vibration treatment system as claimed in claim 8, in which one of said sheets includes at least one extension from one of said three sides and forming a strap integral with the cover and suitable for connecting the cover when applied to a pad to the limb of a patient.

12. A vibration treatment system as claimed in claim 11, in which a closure flap extends from one of said sheets being a front sheet, and the strap or straps extend from the other of said sheets being a rear sheet, the front sheet being the sheet intended, in use, to be against a patient's limb.

13. A cover for a vibratory pad comprising a pocket or pouch faced with dressing fabric material and sized to accommodate a vibration pad, a closure to retain the cover on the pad, in use, and a strap integral with the cover suitable for connecting the cover and a pad retained therein to the limb of a patient, said strap having a connector that is capable of being secured so as to pressure the pad against the limb and so that, once made, the connection cannot be unmade without disabling the connector against making subsequent connections.

14. The cover of claim 13, in which said connector comprises a strip of adhesive and said material of the cover is of the type to which the adhesive adheres non-releasably.

15. The cover of claim 14, in which the adhesive bond, and the cohesive strength of the material adhered, are so strong that the adhesive bond cannot be broken at all, and that, in order to disconnect the pad from a patient's leg, the strap must be broken or cut.

16. The cover of claim 14, in which the adhesive bond is greater than the cohesive strength of the material adhered, whereby, when the strap is disconnected from the cover, a surface layer of the cover or strap is detached, remaining adhered to the adhesive, whereby the strap no longer has capacity to secure the pad to a patient's limb.

17. The cover of claim 14, in which the adhesive bond between the adhesive and the cover material is greater than the cohesive strength of the material of the strap to which the adhesive is adhered, whereby, when the strap is disconnected from the cover, it is the surface layer of the strap that is detached and remains adhered to the adhesive, which itself remains adhered to the cover.

18. The cover of claim 14, in which said cover comprises a single sheet and said connector is in the form of a strap extending from a side of said sheet and adapted to wrap around said pad and said limb, and secure to said sheet, and whereby the sheet is formable into said pouch to accommodate the pad.

19. The cover of claim 14, in which said cover comprises a single sheet and said connector is in the form of at least two pairs of straps extending from either side of said sheet and adapted to wrap around said pad and said limb, and whereby the sheet is formable into said pouch to accommodate the pad.

20. The cover of claim 13, in which said cover comprises a single sheet and said closure comprises a draw string whereby the sheet is formable into said pouch to accommodate the pad.

21. A vibration treatment system comprising a vibratory pad and the cover of claim 13, wherein the vibratory pad comprises a motor driving a vibration element and a pad connected to the motor whereby vibrations caused by rotation of the motor are transmitted to and by the pad.

22. A cover for a vibratory pad comprising a pocket or pouch faced with dressing fabric material and sized to accommodate a vibratory pad, a closure to retain the cover on the pad, in use, and a strap integral with the cover suitable for connecting the cover and a pad retained therein to the limb of a patient, wherein the cover includes electric circuitry comprising a fuse resistor and an interface element configured for connection to an interface element of the vibratory pad, said interface element of the cover comprising one of a plug and socket to complete an electric circuit from the interface element, through the fuse resistor and back to the interface element.

* * * * *